US006511403B2

(12) United States Patent
Hsieh

(10) Patent No.: US 6,511,403 B2
(45) Date of Patent: Jan. 28, 2003

(54) ROTATING PLAY DEVICE CAPABLE OF TRAINING WRIST COORDINATION

(76) Inventor: Jung-Pao Hsieh, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/810,611

(22) Filed: Mar. 19, 2001

(65) Prior Publication Data

US 2002/0132705 A1 Sep. 19, 2002

(51) Int. Cl.[7] ..... A63B 23/14

(52) U.S. Cl. ..... 482/45; 482/44; 482/47; 482/46; 482/49; 446/266; 446/336

(58) Field of Search ..... 482/45–49; 446/266, 446/236

(56) References Cited

U.S. PATENT DOCUMENTS 3,502,335 A * 3/1970 Sholin ..... 273/106
4,429,487 A * 2/1984 Taylor et al. ..... 46/43
5,575,240 A * 11/1996 Udelle et al. ..... 119/707

* cited by examiner

*Primary Examiner*—Jerome W. Donnelly
*Assistant Examiner*—Lori Baker Amerson
(74) *Attorney, Agent, or Firm*—Troxell Law Office PLLC

(57) ABSTRACT

A rotating play device capable of training wrist coordination has a main body of a semi-spherical cage frame braided by the bar skeleton with several ring rails of different breadths formed respectively along the looping ring portions on the spherical surface, crossed and connected on the top surface of the cage frame by several radial and longitudinal rails. A holding cover is mounted on the top surface of the cage frame for the user to hold by finger holes formed in the holding cover. When in use, a ball is placed in the cage frame, and the user holds and rotates the main body of the device by controlling the strength of the wrist and the arm to make the ball roll inside the main body via centrifugal.

1 Claim, 7 Drawing Sheets

ROTATING PLAY DEVICE CAPABLE OF TRAINING WRIST COORDINATION

BACKGROUND OF THE INVENTION

1. Field of the Invention

The invention herein relates to a rotating play device capable of training wrist coordination and provides a rotating play device to achieve the effect of training the coordination of the wrist and exercising the wrist strength through controlling the rotary method and speed of the main body during the playing process. A battery and an assembly of sound and video circuits can be mounted inside a ball body for rolling movement in the device. The rolling of the ball body can activate the circuits via a centrifugal switch in the circuits assembly and make the rolling ball body emit brilliant light along with music to increase the entertaining effect of the device.

2. Description of the Prior Art

For the present, the busy life style not only keeps people from being able to really get away from the job or the interruption of the trivialities in ordinary life to concentrate temporarily on engaging in leisure entertainment. The development of all kinds of playing devices is directed toward multi-functional designs in order to attract the user to continuously use that playing device for achieving entertainment purposes by adding function to the device itself or by having the efficiency derived from the playing movement during the playing and entertaining process. Some development even further extends the idea toward another direction, in other words, of improving the device originally designed purely for exercising physical function to also possess the playing and entertaining effect and to make the user not feel bored while engaging similar trainings of physical function.

SUMMARY OF THE INVENTION

Therefore, the invention herein of a rotating play device capable of training wrist coordination comprises a semi-spherical cage frame as the main body, braided by the bar skeleton with several ring rails of different breadths formed respectively along the looping ring portions on the spherical surface, crossed and connected on the top surface of the cage frame by several radial and longitudinal rails. A holding cover is mounted on the top surface of the cage frame for the user to hid with finger holes formed on the holding cover for the user to choose for inserting the fingers. While in use, a ball body will be placed on any of the ring rails of the cage frame, and the user will hold and rotate the main body of the device by controlling the strength of the wrist and the arm to make the ball body roll inside the main body via centrifugal force. Through controlling the rotary method and speed of the main body during the playing process, the effect of training the coordination of the wrist and exercising the wrist strength will be achieved as the primary objective.

Another objective of the invention herein of a rotating play device capable of training wrist coordination is to have the battery and the assembly of sound and video circuits mounted inside the ball body. The rolling of the ball body can activate the circuits via the centrifugal switch in the circuits assembly and make the rolling ball body emit brilliant light along with music to increase the entertaining effect of the device.

Yet another objective of the invention herein or a rotating play device capable of training wrist coordination is that, in addition to being a play device, it can be taken as a medical rehabilitating device not only used for training the movement of the patient's hand after surgery, but also for adding the playing interest to the rehabilitating process.

To enable a further understanding of the features and the innovation of the invention herein, the brief description of the drawings below is followed by the detailed description of the preferred embodiment.

DETAILED DESCRIPTION OF THE PREFERRED EMBODIMENTS

Figure 1:
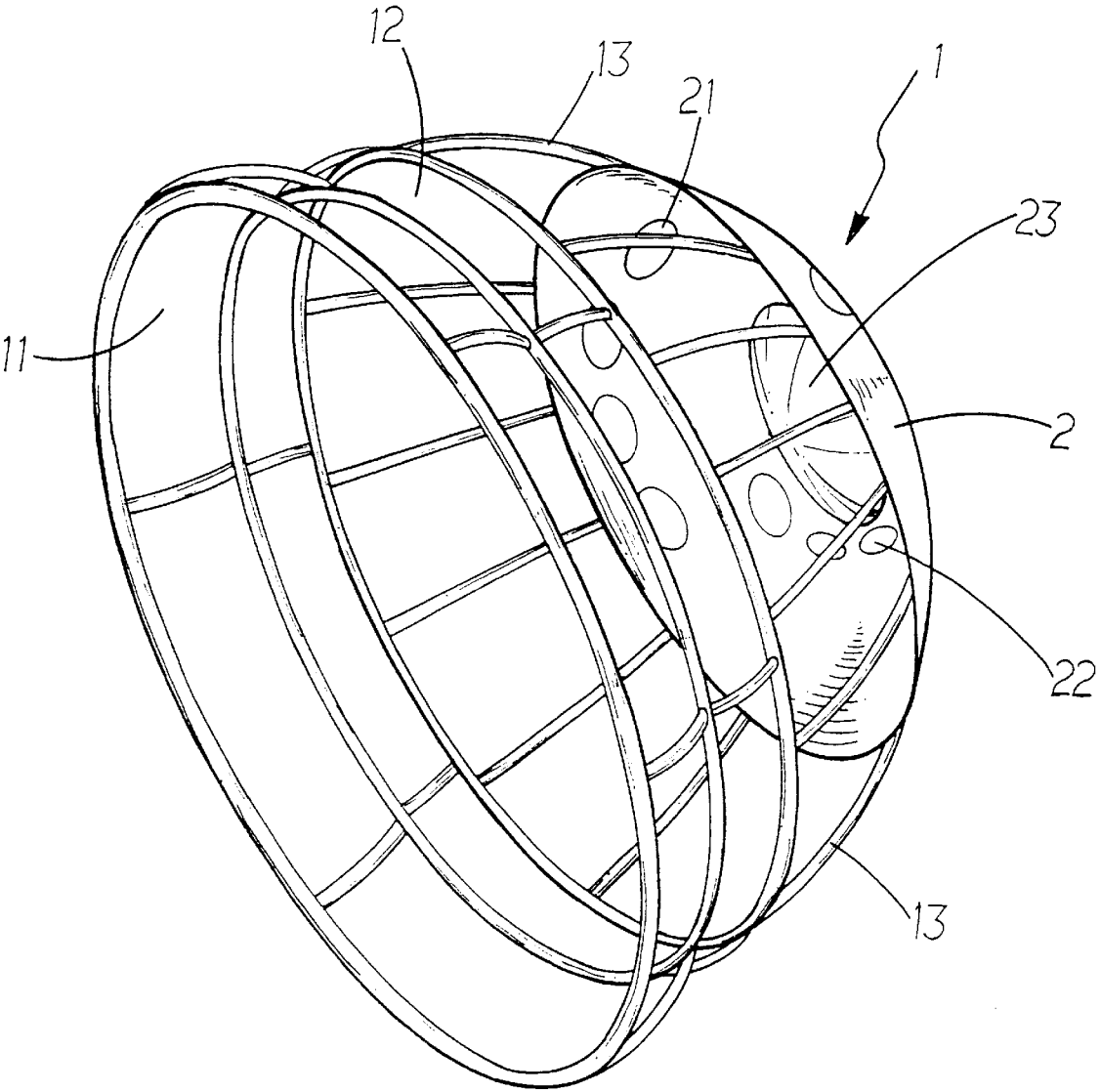
FIG. 1 is a perspective view of a preferred embodiment of the device of the invention herein.
Figure 2:
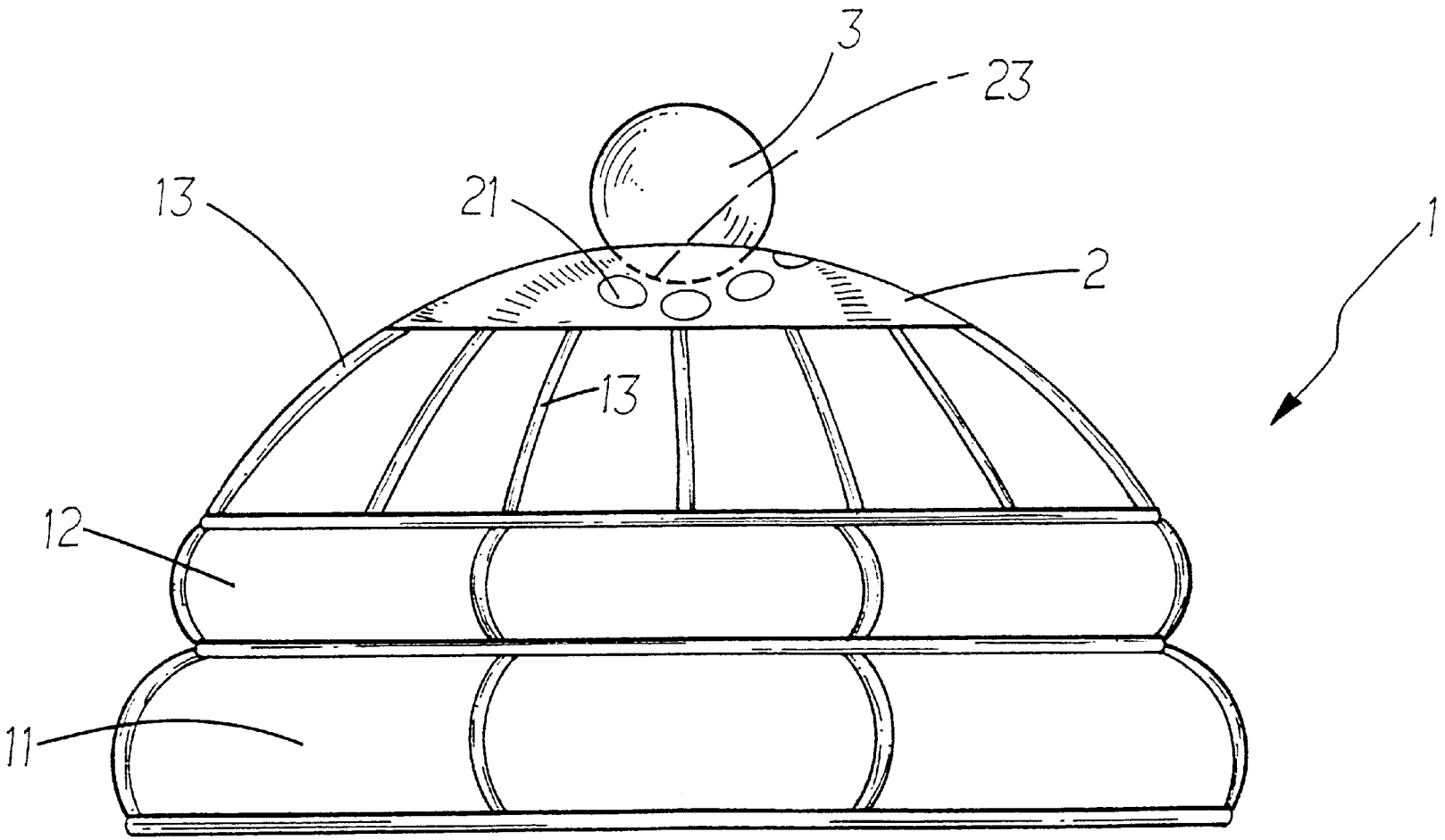
FIG. 2 is a side view of the invention herein.
Figure 3:
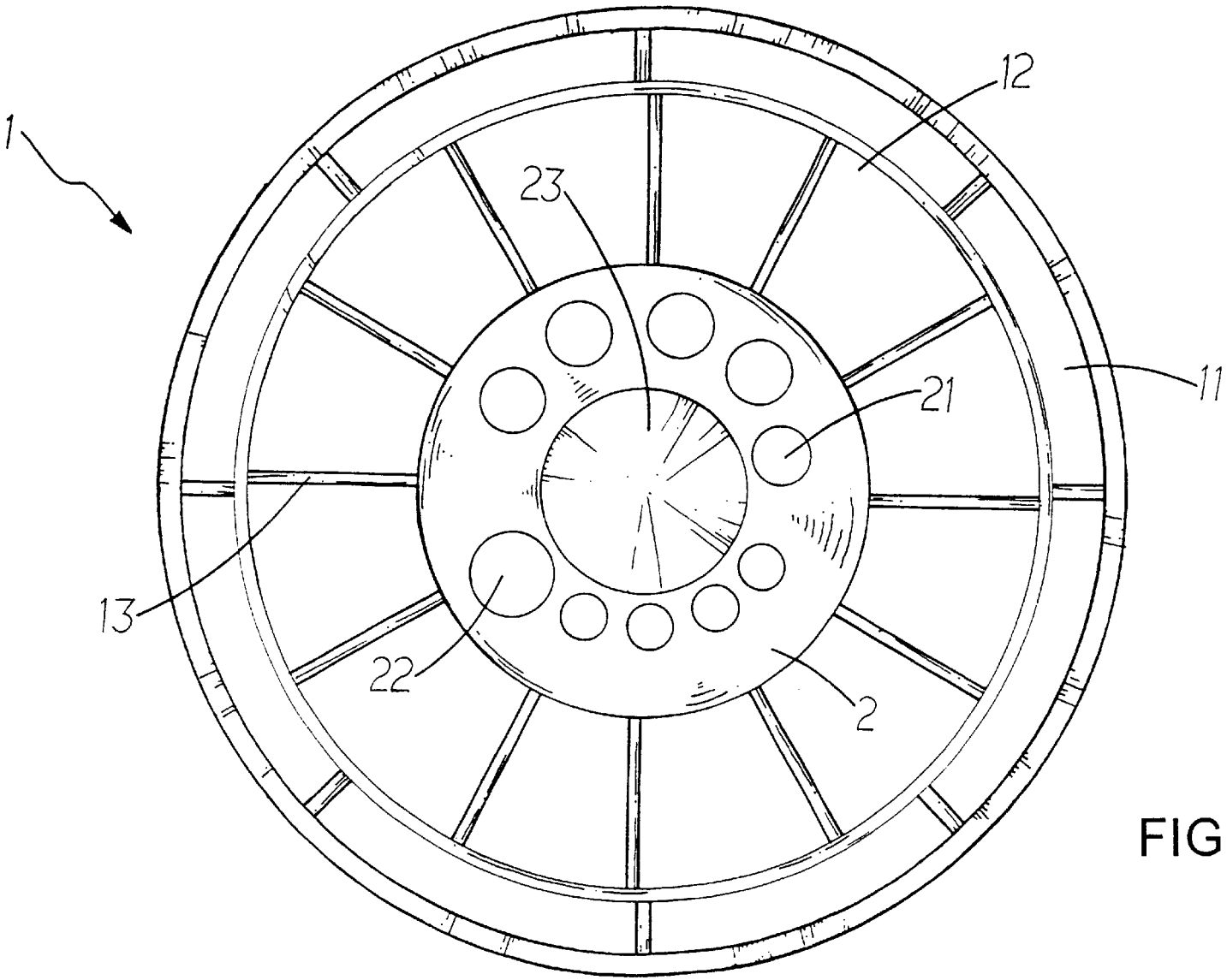
FIG. 3 is a top view of the invention herein.

The device of the invention herein relating to a rotating play device capable of training wrist coordination comprises a main body to be held by the user and a ball body to roll inside the main body. Through controlling the strength of the wrist and the arm, the user can hold and rotate the main body and the ball body will roll inside the main body via centrifugal force while the main body is rotating. Therefore, not only the playing and entertaining effect is possessed, but also the efficiency of training the coordination of the wrist and exercising the wrist strength is achieved through controlling the rotary method and speed of the main body during the playing process. The structure of the entire rotating play device is shown in FIGS. 1 and 2, wherein the main body of the rotating play device is a semi-spherical cage frame (1) braided by the bar skeleton; the looping ring portions on the spherical surface are formed respectively by the first ring rail (11) and the second ring rail (12) (in the cage frame shown in these Figures, only the first ring rail of wider breadth and the second ring rail of narrower breadth are used as examples; the real product can have more ring rails mounted for variations to adapt to different technical levels) crossed and connected on the top surface of the cage frame (1) by several radial and longitudinal rails (13). A holding cover (2) is mounted on the top surface of the cage frame (1) for the user to hold and finger holes (21, 22) are formed in the holding cover (2) according to the different sizes of the user's hands of either an adult or a child. Referring to FIGS. 2 and 3, the uppermost end on the holding cover (2) is a concave ball seat (23) for placing the ball (3) therein while not in use to form an ornament styled in special interest.

Figure 4:
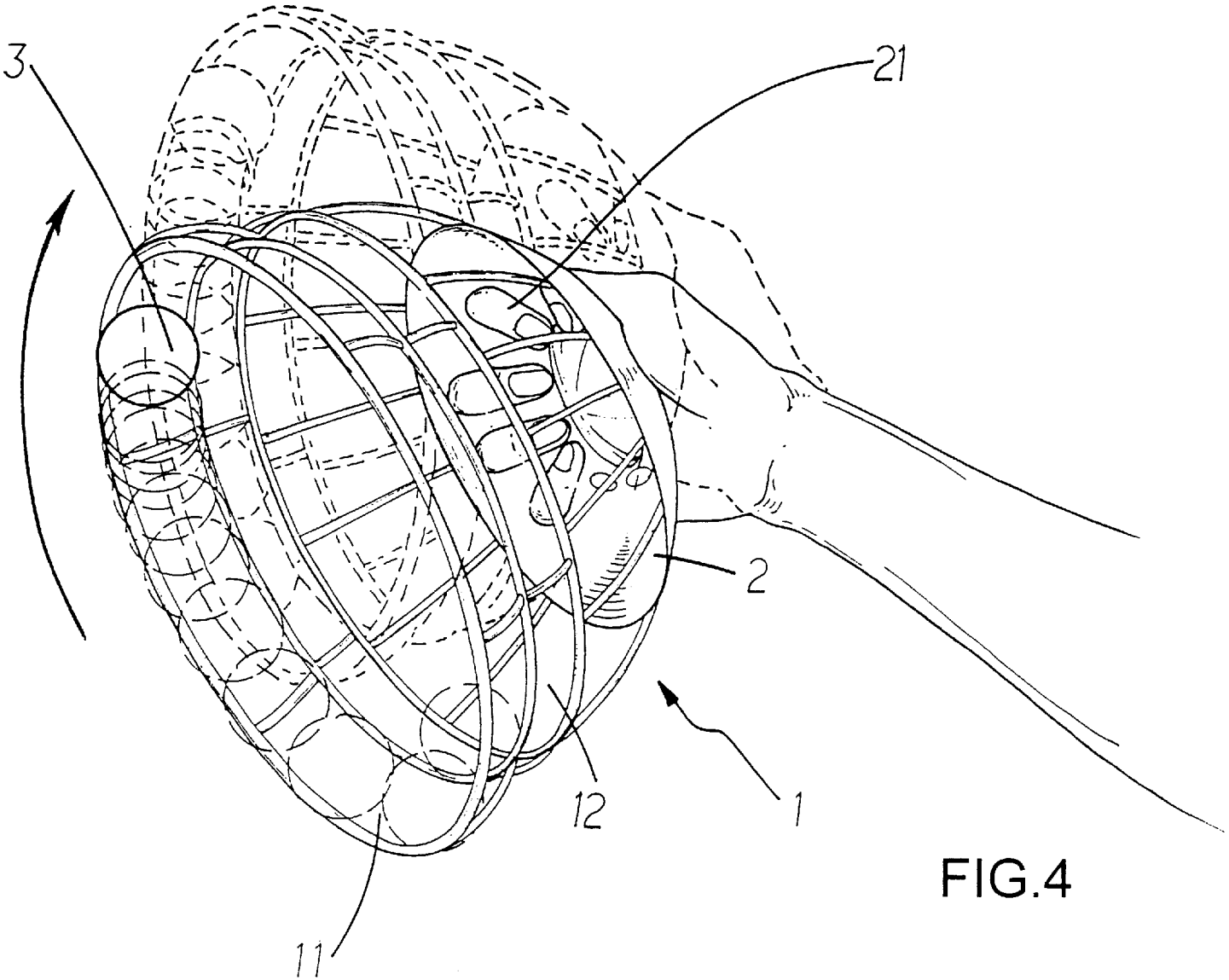
FIG. 4 is an isometric drawing of the invention herein in application.

Referring to FIG. 4, when the primary learner uses the invention herein of a rotating play device, he will insert his fingers into the proper finger holes (21) chosen according to the sizes of his hands and hold the cage frame (1) with its opening facing to the left or to the right. The ball (3) will also be placed inside the cage frame (1). At the same time, the cage frame (1) will rotate in proper speed and range through the user's controlling of the strength of the wrist and the arm, and the ball (3) will fling outwards and fall naturally into the first ring rail (11) or the second ring rail (12) without falling outside the cage frame (1) due to the framing of the rails. Of course, the primary learner can also place the ball body (3) directly on the first ring rail (11) of wider breadth. The left and right swinging of the cage frame (10), the wider breadth of the first ring rail (11) and the strong force on the ball body (3) will drive the ball body without falling to roll and proceed continuously on the rail to achieve the entertaining effect.

Figure 5:
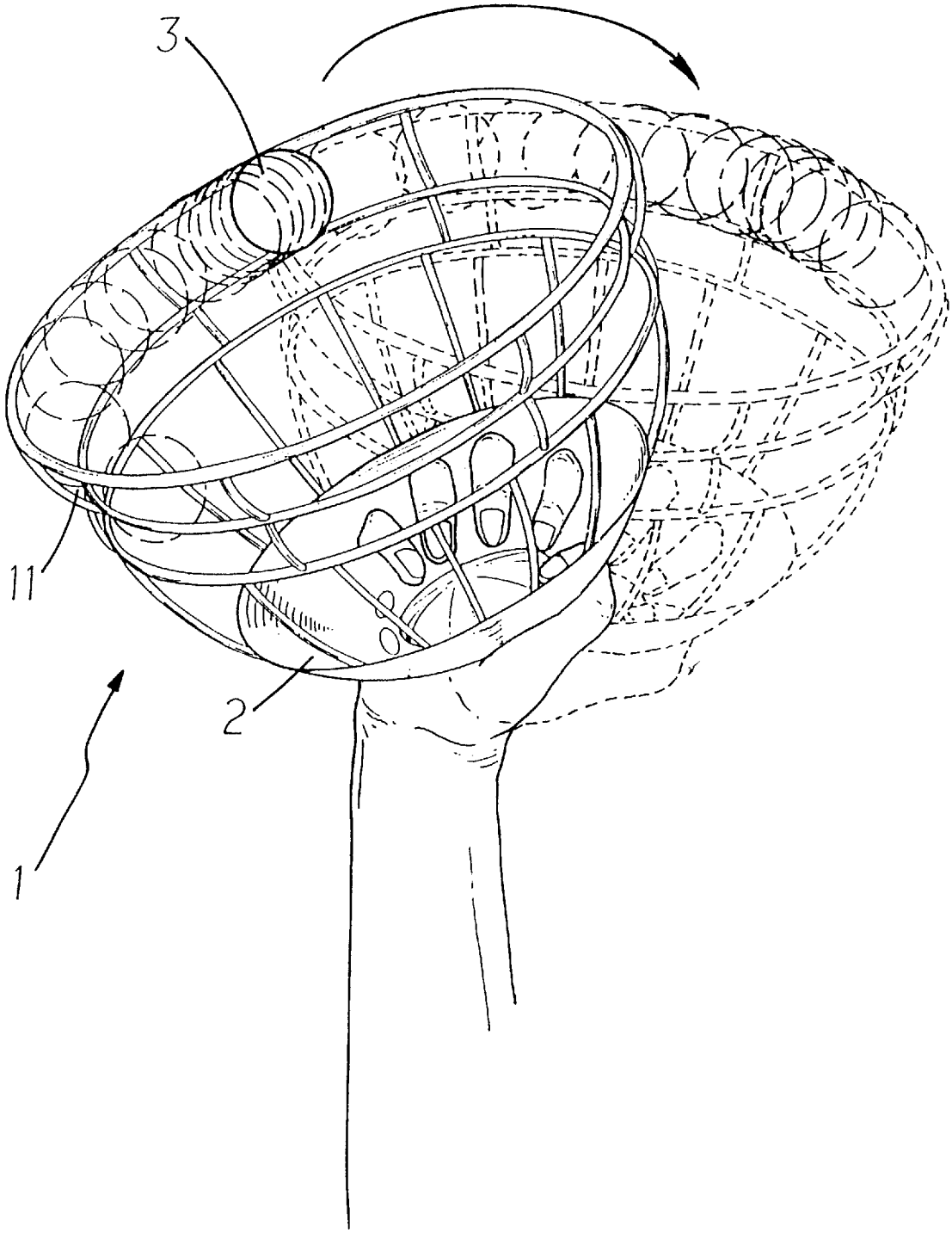
FIG. 5 is another isometric drawing of the invention herein in application.
Figure 6:
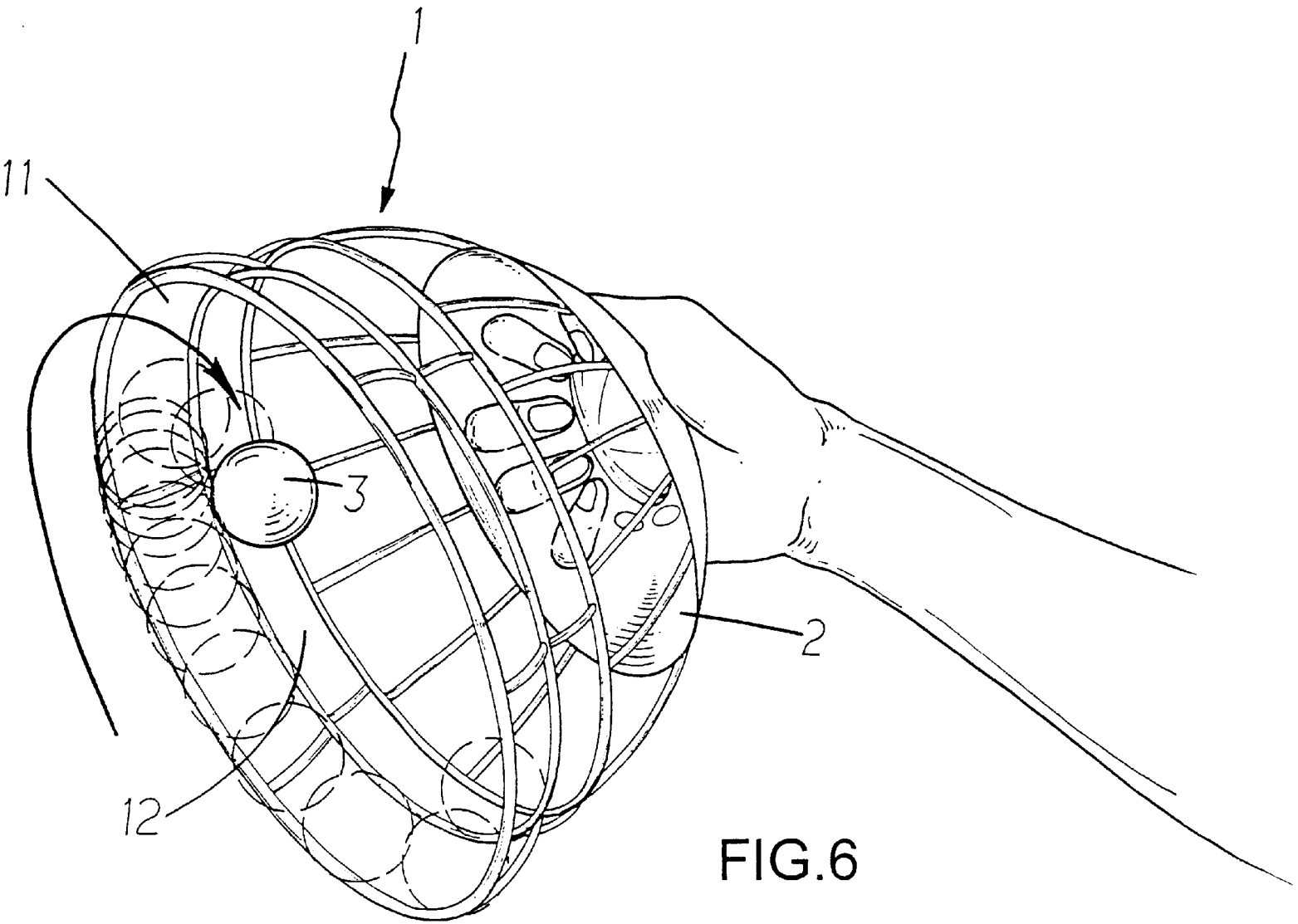
FIG. 6 is an isometric drawing of the rail changing process of the invention herein in application.
Figure 7:
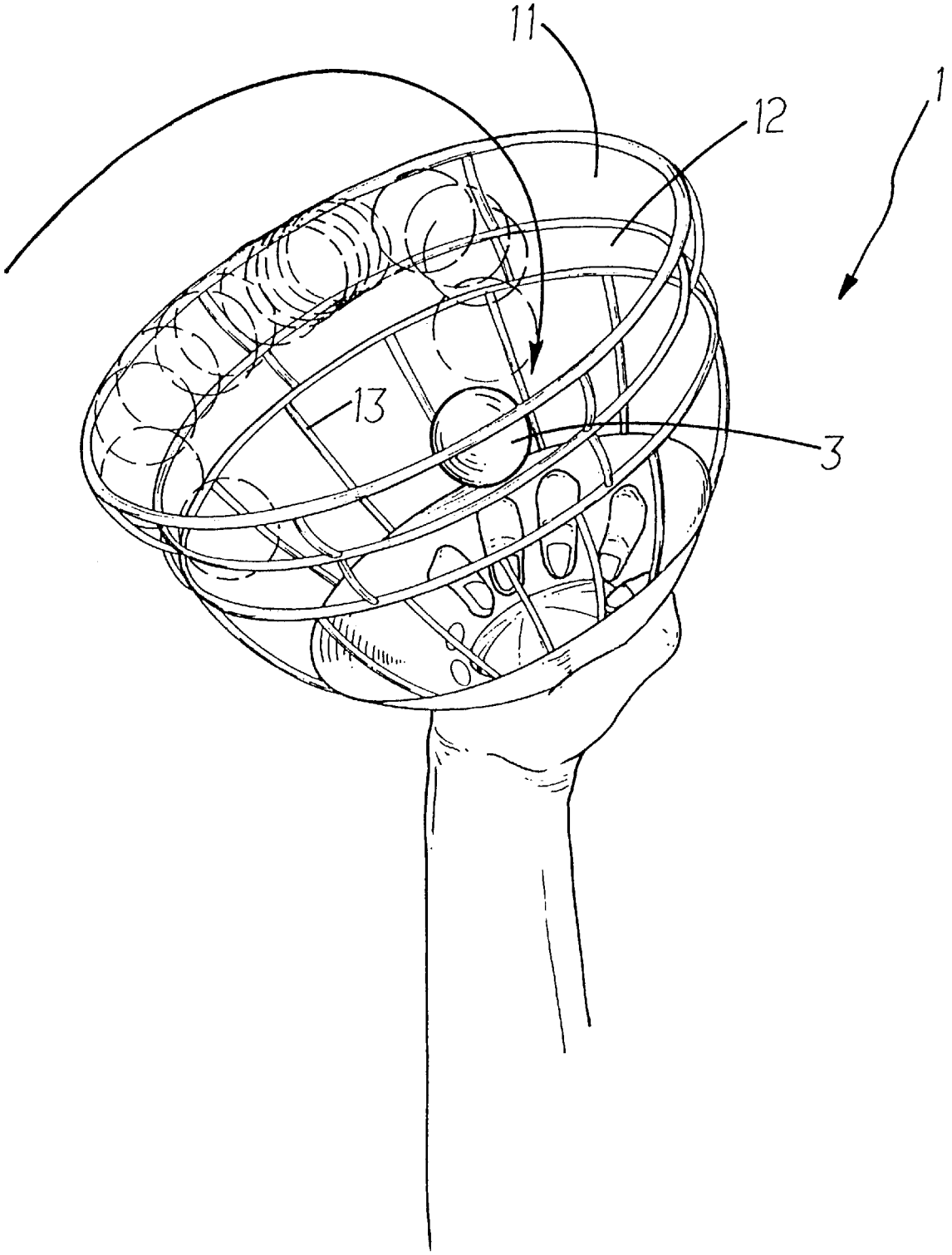
FIG. 7 is an isometric drawing of the resuming ball body of the invention herein in application.

Furthermore, after the user has become familiar with operating the rotating play device and controlling the strength and coordination of the wrist, he is then able to, as shown in FIG. 5, rotate the cage frame (1) by holding the cage frame (1) at different angles to create various figured movements of rotating the cage frame (1), or, even as shown in FIG. 6, when the ball body (3) is rolling, by adjusting the strength of wrist and the moving techniques of deflecting the angle of the cage frame (1), the user can make the ball body (3) roll on a different rail, thus to show various interesting ways of playing the entire rotating play device. When the operator wants to stop playing, as shown in FIG. 7, he only has to turn the opening of the cage frame (1) upwards to reduce the rotating force, then due to the weight of itself, the ball body (3) will fall into the cage frame (1) along the longitudinal rail (13) instead of falling to the other locations.

Of course, in addition to the playing and entertaining effect of the basic controlling of the rolling ball body (3), the invention herein of the rotating play device can have a battery and an assembly of sound and video circuits mounted inside the ball body such that the rolling of the ball body activates the circuits via a centrifugal switch in the circuits assembly and make the rolling ball send out brilliant light along with music to increase the entertaining effect of the entire device.

The invention herein of a rotating play device, capable of training wrist coordination utilizing the rolling methods of the ball body inside the main body of the cage frame, is not only capable of achieving the playing and entertaining objectives by different rolling methods through the user's controlling the strength of the wrist and the coordination between the wrist and the arm, but is also capable of achieving the effect of training the coordination of the wrist and exercising the strength of the wrist, and provides a preferred play device.

What is claimed is:

1. A rotating play device comprising:

a) a semi-spherical cage frame formed by a plurality of longitudinally spaced apart circumferential ring rails forming a plurality of circumferential rings therebetween, the plurality of spaced apart circumferential ring rails connected together by a plurality of circumferentially spaced apart longitudinal rails;

b) a holding cover on the semi-spherical cage frame having a plurality of finger holes therein, and, c) a ball body in the spherical cage whereby rotation of the semi-spherical cage frame causes the ball body to travel around one of the plurality of circumferential rings.

* * * * *